US010494973B2

(12) United States Patent
Takayanagi et al.

(10) Patent No.: US 10,494,973 B2
(45) Date of Patent: Dec. 3, 2019

(54) CATALYTIC CONVERTER AND METHOD FOR MANUFACTURING CASING

(71) Applicants: YUTAKA GIKEN CO., LTD., Hamamatsu-Shi, Shizuoka (JP); HONDA MOTOR CO., LTD., Minato-Ku, Tokyo (JP)

(72) Inventors: Jun Takayanagi, Hamamatsu (JP); Toshihiro Ooka, Hamamatsu (JP); Noritaka Yamamoto, Wako (JP); Kazumasa Ishii, Wako (JP); Yoshiaki Hatakeyama, Wako (JP)

(73) Assignees: Yutaka Giken Co., Ltd., Shizuoka (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/023,551

(22) Filed: Jun. 29, 2018

(65) Prior Publication Data

US 2019/0024560 A1 Jan. 24, 2019

(30) Foreign Application Priority Data

Jul. 21, 2017 (JP) ..... 2017-141797
Nov. 21, 2017 (JP) ..... 2017-223388

(51) Int. Cl.
*F01N 3/28* (2006.01)
*F01N 13/00* (2010.01)
(Continued)

(52) U.S. Cl.
CPC ..... *F01N 3/2803* (2013.01); *B21D 15/02* (2013.01); *F01N 3/2842* (2013.01);
(Continued)

(58) Field of Classification Search
None
See application file for complete search history.

(56) References Cited

U.S. PATENT DOCUMENTS 7,897,117 B2 3/2011 Balk et al.

FOREIGN PATENT DOCUMENTS

JP 2000-073755 A 3/2000
JP 2002-097944 A 4/2002
(Continued)

OTHER PUBLICATIONS

Kurokawa et al. JP2011185115A-translated document (Year: 2011).*
(Continued)

*Primary Examiner* — Jelitza M Perez
(74) *Attorney, Agent, or Firm* — Carrier Blackman & Associates, P.C.; William D. Blackman; Joseph P. Carrier

(57) ABSTRACT

A catalytic converter includes: a tubular casing including at least a pair of holding tubular parts and a reduced diameter tubular part that integrally connects the holding tubular parts to each other; and a monolithic catalyst carrier accommodated in each of the holding tubular parts, the reduced diameter tubular part being obtained by press-forming a portion, between the holding tubular parts, of a casing material of a tubular shape that corresponds to that of the holding tubular parts. Flat parts are formed respectively in a plurality of places at intervals in a peripheral direction of the reduced diameter tubular part, a sensor being attached to at least one of the flat parts. Accordingly, a press load when press-forming the reduced diameter tubular part is suppressed from becoming large and unequal in the peripheral direction of the reduced diameter tubular part.

12 Claims, 9 Drawing Sheets

(51) Int. Cl.

| | |
|---|---|
| ***B21D 15/02*** | (2006.01) |
| ***F01N 13/18*** | (2010.01) |
| *B21D 53/88* | (2006.01) |

(52) U.S. Cl.

CPC ..... *F01N 13/008* (2013.01); *F01N 13/0093* (2014.06); *F01N 13/0097* (2014.06); *F01N 13/1872* (2013.01); *B21D 53/88* (2013.01); *F01N 2450/20* (2013.01); *F01N 2450/22* (2013.01)

(56) References Cited

FOREIGN PATENT DOCUMENTS

| | | | | |
|---|---|---|---|---|
| JP | 2004-092461 | A | | 3/2004 |
| JP | 2009-127604 | A | | 6/2009 |
| JP | 2010-511825 | A | | 4/2010 |
| JP | 2011185115 | A | * | 9/2011 |
| JP | 2012-117443 | A | | 6/2012 |
| JP | 2012117443 | A | * | 6/2012 |

OTHER PUBLICATIONS

Mori et al. (JP2012-117443A)-translated document (Year: 2012).*
Official Communication (Decision of Granting a Patent) issued in the corresponding JP Patent Application 2017-223388, dated Dec. 5, 2018.

* cited by examiner

CATALYTIC CONVERTER AND METHOD FOR MANUFACTURING CASING

BACKGROUND OF THE INVENTION

Field of the Invention

The present invention relates to a catalytic converter comprising: a tubular casing including at least a pair of holding tubular parts and a reduced diameter tubular part that integrally connects the holding tubular parts to each other; and a monolithic catalyst carrier accommodated in each of the holding tubular parts, the reduced diameter tubular part being obtained by press-forming a portion, between the holding tubular parts, of a casing material of a tubular shape that corresponds to that of the holding tubular parts. The present invention also relates to a method for manufacturing the casing.

Description of the Related Art

Such a catalytic converter is known in, for example, Japanese Patent Application Laid-open No. 2004-92461 and Japanese Patent Application Laid-open No. 2012-117443.

In a catalytic converter disclosed in the above-described Japanese Patent Application Laid-open No. 2004-92461, a single flat part is provided in a reduced diameter tubular part of a casing, and a mounting seat for mounting a sensor is formed in the flat part. Therefore, a press load in one direction for forming the single flat part acts on the reduced diameter tubular part, and this results in unequal loads acting in a peripheral direction of the reduced diameter tubular part, which may deform opposite end portions of the casing in their spreading direction, thereby requiring complicated troublesome work in order to correct the deformation.

On the other hand, in a catalytic converter disclosed in the above-described Japanese Patent Application Laid-open No. 2012-117443, a reduced diameter tubular part is formed of a single flat part and a plurality of major arc-shaped parts connecting opposite end portions of the flat part to each other. A peripheral length of the reduced diameter tubular part is adjusted by the major arc-shaped parts so as to prevent occurrence of wrinkles on the reduced diameter tubular part. However, there are problems that it is difficult to form the major arc-shaped parts and the adjustment of the peripheral length becomes complicated. In addition, since a press load in one direction for forming the single flat part acts on the reduced diameter tubular part, unequal loads act on the reduced diameter tubular part in a peripheral direction thereof, similarly as in the catalytic converter disclosed in the above-described Japanese Patent Application Laid-open No. 2004-92461.

SUMMARY OF THE INVENTION

The present invention has been accomplished in light of such circumstances, and it is an object thereof to provide a catalytic converter capable of suppressing a press load, when press-forming a reduced diameter tubular part of a casing, from becoming large and unequal in a peripheral direction of the reduced diameter tubular part, and also to provide a method for manufacturing the casing, in which the casing can be manufactured appropriately.

In order to achieve the object, according to a first aspect of the present invention, there is provided a catalytic converter comprising: a tubular casing including at least a pair of holding tubular parts and a reduced diameter tubular part that integrally connects the holding tubular parts to each other; and a monolithic catalyst carrier accommodated in each of the holding tubular parts, the reduced diameter tubular part being obtained by press-forming a portion, between the holding tubular parts, of a casing material of a tubular shape that corresponds to that of the holding tubular parts, wherein flat parts are formed respectively in a plurality of places at intervals in a peripheral direction of the reduced diameter tubular part, a sensor being attached to at least one of the flat parts.

In accordance with the first aspect, since press loads act on the casing material from a plurality of directions in order to form the flat parts, it is possible to prevent the press loads from becoming large and unequal in the peripheral direction of the reduced diameter tubular part and minimize an amount of deformation per one place of the reduced diameter tubular part.

According to a second aspect of the present invention, in addition to the first aspect, a pair of the flat parts are formed in the reduced diameter tubular part so as to extend along a pair of imaginary planes orthogonal to each other.

In accordance with the second aspect, since the pair of flat parts formed in the reduced diameter tubular part extend along the pair of imaginary planes orthogonal to each other, the flat parts influence each other so that one of the flat parts suppresses the other flat part from deforming, thereby enabling an amount of deformation per one place of the reduced diameter tubular part to be minimized.

According to a third aspect of the present invention, in addition to the first aspect, the flat parts are formed respectively in a plurality of places at equal intervals in the peripheral direction of the reduced diameter tubular part.

In accordance with the third aspect, since the flat parts are formed respectively in the plurality of places at equal intervals in the peripheral direction of the reduced diameter tubular part, the flat parts are disposed with a proper balance in the reduced diameter tubular part. Therefore, each adjacent flat parts reinforce each other so as to be able to enhance strength of the reduced diameter tubular part, thereby reducing a thickness of the casing material so as to be able to reduce a weight of the casing.

According to a fourth aspect of the present invention, in addition to any one of the first to third aspects, first protrusions are respectively formed on opposite end portions, along the peripheral direction of the reduced diameter tubular part, of each of the flat parts, the first protrusions protruding outward of the reduced diameter tubular part and extending in an axial direction of the reduced diameter tubular part.

In accordance with the fourth aspect, since the first protrusions protruding outward of the reduced diameter tubular part and extending in the axial direction thereof are respectively formed on the opposite end portions of each of the flat parts, radially inward contraction of portions of the reduced diameter tubular part due to formation of the flat parts can be absorbed by the first protrusions and it is also possible to contribute to enhancement of strength of the flat parts.

According to a fifth aspect of the present invention, in addition to the fourth aspect, second protrusions are each formed on an outer surface of the reduced diameter tubular part at a central portion in the peripheral direction between each adjacent ones of the plurality of flat parts, the second protrusions protruding outward of the reduced diameter tubular part and extending in the axial direction of the reduced diameter tubular part.

In accordance with the fifth aspect, since the second protrusions are each formed on the outer surface of the reduced diameter tubular part at the central portion in the peripheral direction between each adjacent ones of the plurality of flat parts, it is possible to minimize a difference in peripheral length between the reduced diameter tubular part and the holding tubular parts, prevent wrinkles and the like from occurring on the reduced diameter tubular part, and further enhance the strength of the reduced diameter tubular part.

According to a sixth aspect of the present invention, in addition to any one of the first to third aspects, the casing material is an electric resistance welded tube which has an electric resistance welded part disposed in one of the plurality of flat parts.

In accordance with the sixth aspect, since the casing material is an electric resistance welded tube and the electric resistance welded part is disposed in one of the plurality of flat parts, in a cross sectional shape of the casing, that portion of the casing in which the electric resistance welded part is disposed does not change in shape, and compared with an uneven shape, stress applied to the electric resistance welded part can be reduced.

According to a seventh aspect of the present invention, in addition to the fifth aspect, the casing material is an electric resistance welded tube which has an electric resistance welded part disposed in one of the plurality of second protrusions.

In accordance with the seventh aspect, since the casing material is an electric resistance welded tube and the electric resistance welded part is disposed in one of the plurality of second protrusions, an amount of deformation of the electric resistance welded part can be minimized so as to reduce a burden applied to the electric resistance welded part.

According to an eighth aspect of the present invention, there is provided a method for manufacturing the casing in the catalytic converter according to any one of the first to third aspects, comprising obtaining the reduced diameter tubular part by press-forming a portion, between the holding tubular parts, of the tubular casing material by using a plurality of split molds that are divided in a peripheral direction of the casing material and include split molds each having a flat surface for forming the flat part.

In accordance with the eighth aspect, since the reduced diameter tubular part is formed by using the plurality of split molds that include split molds each having the flat surface for forming the flat part, a press load by one split mold can be reduced so as to minimize an amount of deformation of the reduced diameter tubular part, and thus it is possible to form the casing while suppressing the deformation of the reduced diameter tubular part.

The above and other objects, characteristics and advantages of the present invention will be clear from detailed descriptions of the preferred embodiments which will be provided below while referring to the attached drawings.

DESCRIPTION OF THE PREFERRED EMBODIMENTS

Figure 1:
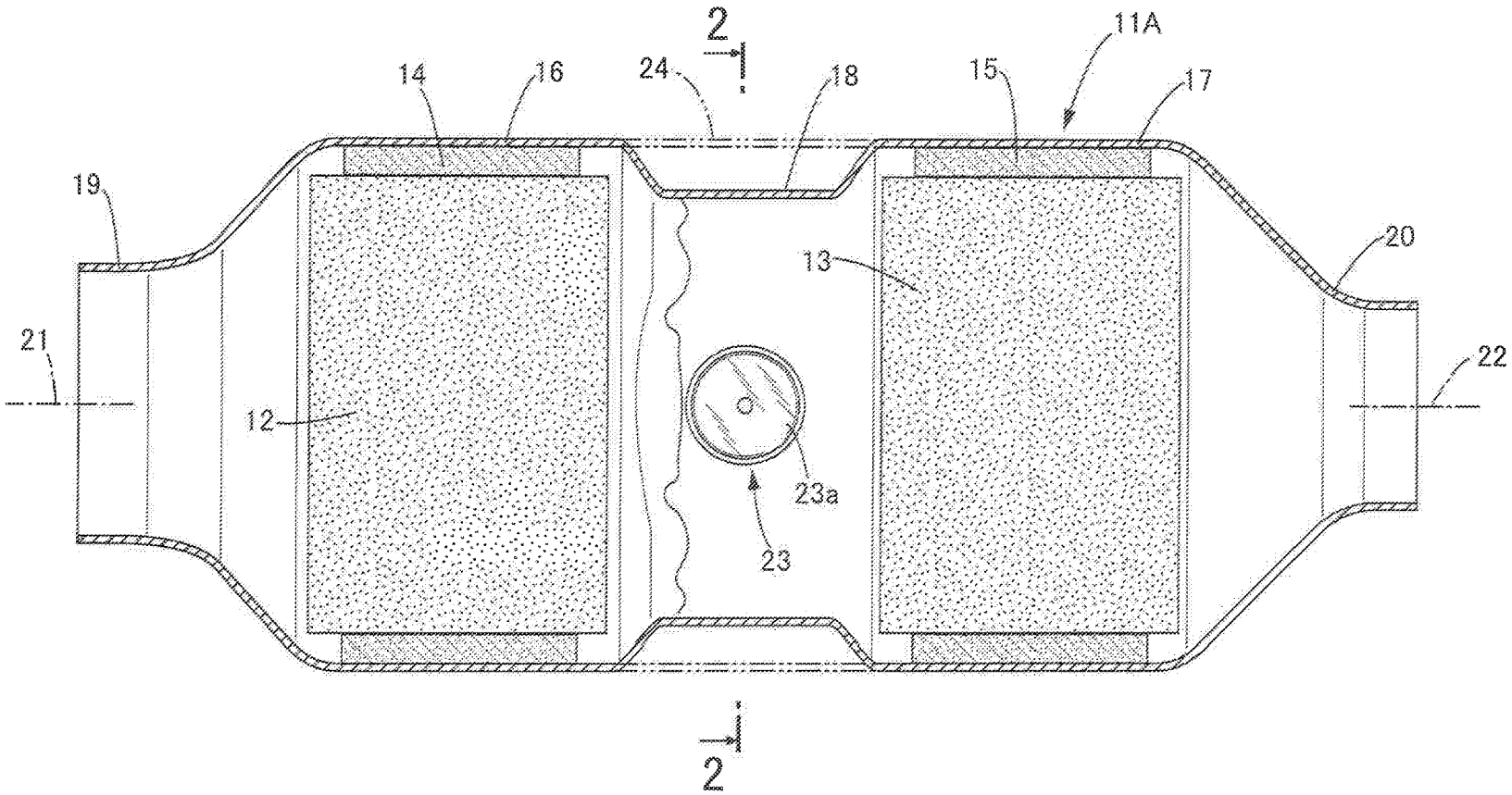
FIG. 1 is a longitudinal sectional view of a catalytic converter according to a first embodiment.
Figure 2:
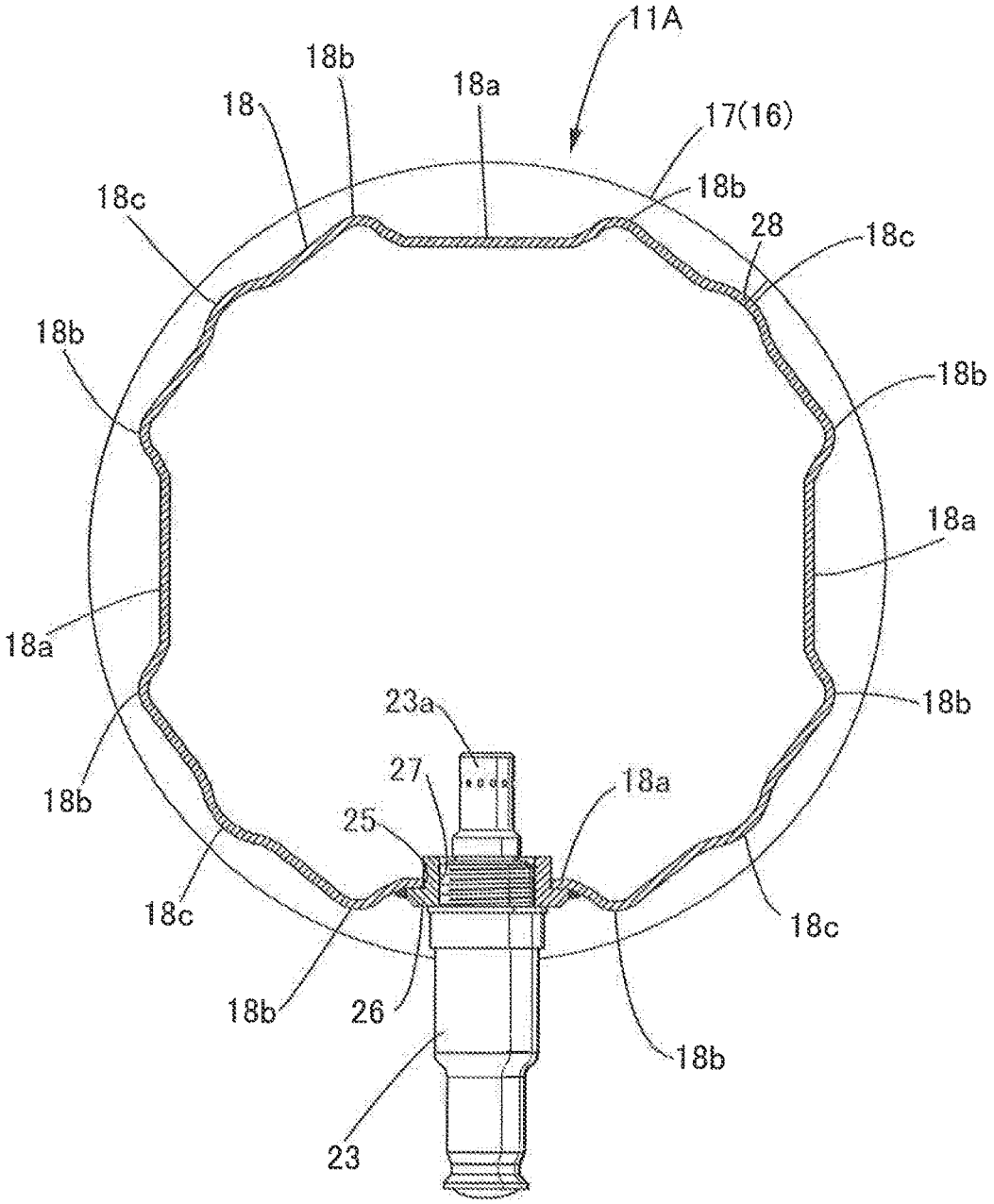
FIG. 2 is a sectional view along line 2-2 in FIG. 1.

Embodiments of the present invention are explained below referring to the attached drawings.

A first embodiment of the present invention is now explained referring to FIGS. 1 to 4. First, in FIG. 1, a catalytic converter includes a tubular, for example, cylindrical casing 11A and a plurality of, for example, two monolithic catalyst carriers 12 and 13 that are accommodated in series inside the casing 11A so as to be separated from each other in a direction along an axis of the casing 11A, elastic mats 14 and 15 as holding materials being respectively wound around outer peripheries of the monolithic catalyst carriers 12 and 13.

The casing 11A is formed so as to integrally include at least one pair of (a pair of, in this embodiment) holding tubular parts 16 and 17, a reduced diameter tubular part 18 integrally connecting the holding tubular parts 16 and 17 to each other, and a pair of funnel-shaped connecting tubular parts 19 and 20 respectively connected to end portions, on sides opposite to the reduced diameter tubular part 18, of the pair of holding tubular parts 16 and 17.

The monolithic catalyst carriers 12 and 13 are respectively fitted into and held in the holding tubular parts 16 and 17 via the elastic mats 14 and 15. An upstream exhaust pipe 21 continuous to an exhaust port (not illustrated) of an internal combustion engine for a vehicle is connected to the connecting tubular part 19 that is one of the connecting tubular parts 19 and 20, and the other connecting tubular part 20 is connected to an exhaust muffler (not illustrated) via a downstream exhaust pipe 22.

Exhaust gas discharged from the internal combustion engine is guided from the upstream exhaust pipe 21 into the casing 11A, and then passes through the pair of monolithic catalyst carriers 12 and 13 sequentially so that harmful substances in the exhaust gas are purified by an oxidation reduction effect. The purified exhaust gas passes through the downstream exhaust pipe 22 and the exhaust muffler and is thereafter released into an atmosphere.

At least one sensor, one $O_2$ sensor 23 in this embodiment is attached to the reduced diameter tubular part 18 of the casing 11A. The $O_2$ sensor 23 detects an $O_2$ concentration in the exhaust gas between the pair of the monolithic catalyst carriers 12 and 13 and inputs the detected signal into an electronic control unit that is not illustrated. Based on the $O_2$ concentration obtained in the $O_2$ sensor 23, the electronic control unit controls an amount of fuel that is to be supplied to the internal combustion engine, and thereby an air-fuel ratio of an intake air-fuel mixture of the internal combustion engine is appropriately controlled.

The reduced diameter tubular part 18 of the casing 11A is obtained by press-forming a portion, between the holding tubular parts 16 and 17, of a casing material 24 of a tubular shape that corresponds to that of the holding tubular parts 16 and 17. Flat parts 18*a* are formed respectively in a plurality of places at intervals in a peripheral direction of the reduced diameter tubular part 18, the $O_2$ sensor 23 being attached to at least one (one in this embodiment) of the flat parts 18*a*.

The flat parts 18*a* are formed respectively in a plurality of, preferably three to six places at equal intervals in the peripheral direction of the reduced diameter tubular part 18. In this embodiment, the flat parts 18*a* are formed in four places at equal intervals in the peripheral direction of the reduced diameter tubular part 18.

In one of the flat parts 18*a*, to which the $O_2$ sensor 23 is attached, an attaching hole 25 is formed. A sensor attaching boss 26 is fitted into the attaching hole 25 and fixed by welding to the one flat part 18*a*. The sensor attaching boss 26 has a screw hole 27, and the $O_2$ sensor 23 is screwed into the screw hole 27. A sensing part 23*a* provided at a tip end portion of the $O_2$ sensor 23 is disposed in an intermediate portion between the pair of the monolithic catalyst carriers 12 and 13.

Moreover, first protrusions or ribs 18*b* are respectively formed on opposite end portions, along the peripheral direction of the reduced diameter tubular part 18, of each of the flat parts 18*a*, the first protrusions 18*b* protruding outward of the reduced diameter tubular part 18 and extending in an axial direction of the reduced diameter tubular part 18. In addition, second protrusions or ribs 18*c* are each formed on an outer surface of the reduced diameter tubular part 18 at a central portion in the peripheral direction between each adjacent ones of the plurality of flat parts 18*a*, the second protrusions 18*c* protruding outward of the reduced diameter tubular part 18 and extending in the axial direction thereof.

Figure 3:
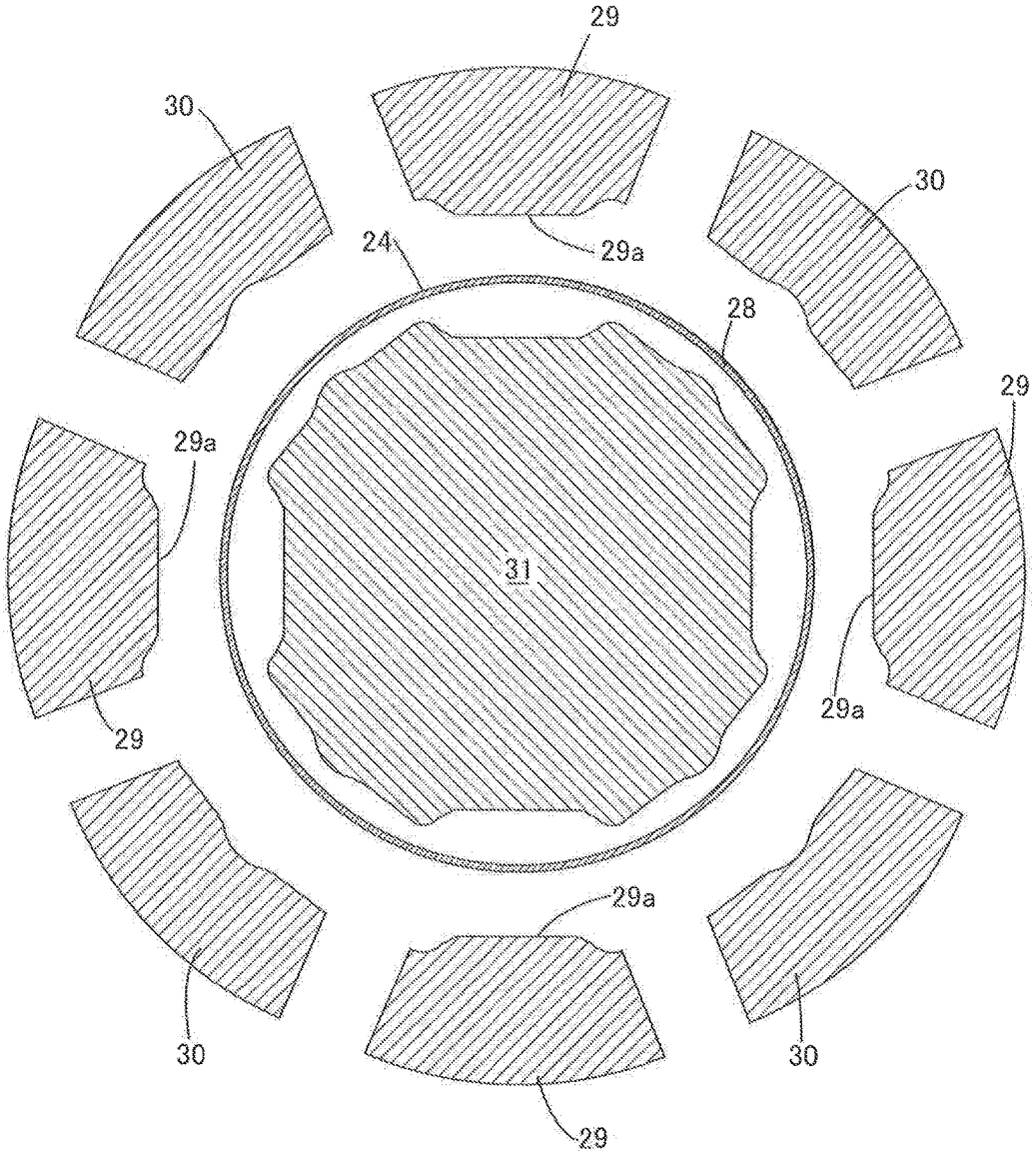
FIG. 3 is a cross sectional view of a press-forming device before press-forming.

In FIG. 3, the casing material 24 is formed from an electric resistance welded tube including an electric resistance welded part 28. The reduced diameter tubular part 18 is obtained by press-forming the portion, between the holding tubular parts 16 and 17, of the casing material 24 by using a plurality of split molds 29 and 30 that are divided in a peripheral direction of the casing material 24, the split molds 29 each having a flat surface 29*a* for forming the flat part 18*a*. In this embodiment, four split molds 29 each having the flat surface 29*a* and four split molds 30 are disposed outside the casing material 24, the split molds 30 corresponding to portions, other than the flat parts 18*a*, of the reduced diameter tubular part 18. A core mold 31 is fixedly disposed inside the casing material 24, a shape of an outer periphery of the core mold 31 corresponding to a shape of an inner periphery of the reduced diameter tubular part 18.

Figure 4:
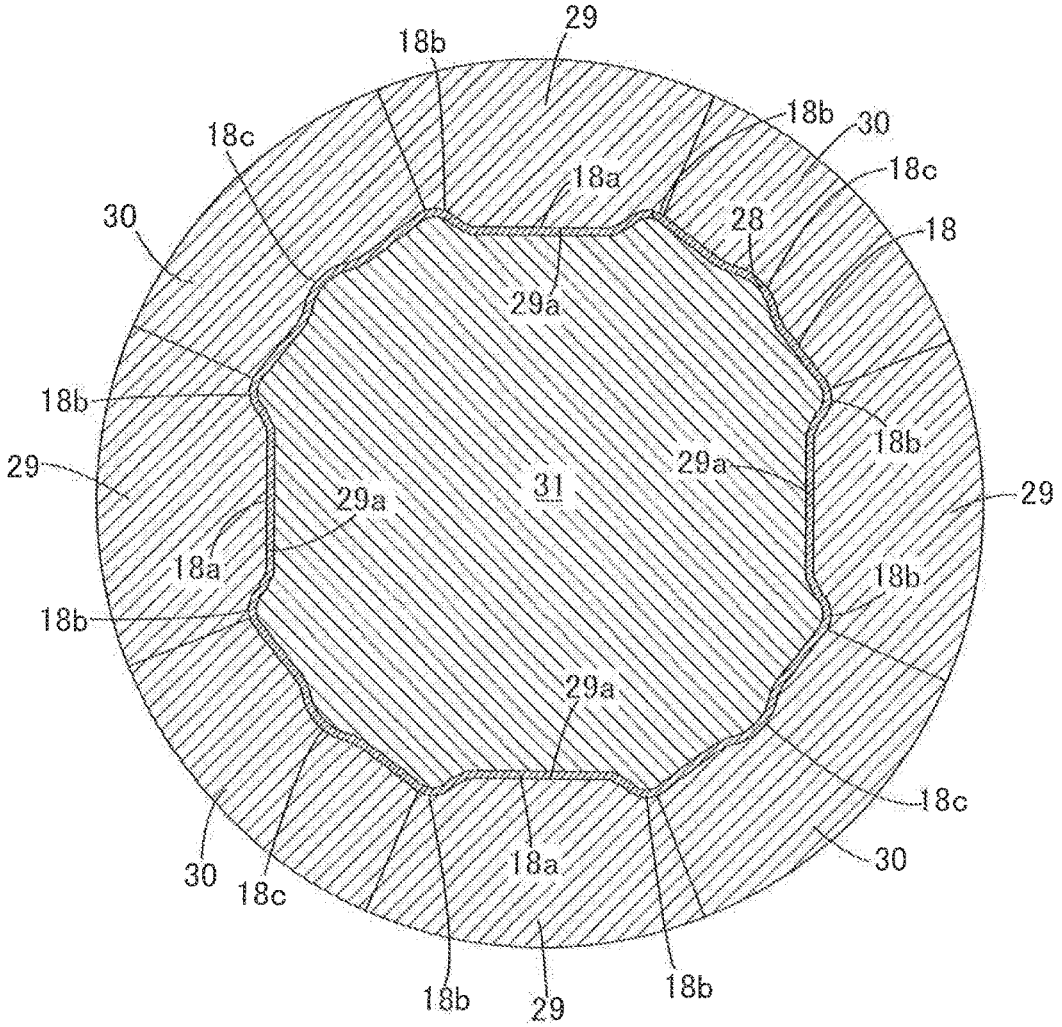
FIG. 4 is a cross sectional view of the press-forming device after completing press-forming.

The casing material 24 is press-formed radially inward toward the core mold 31 by using the eight split molds 29 and 30 as described above, so that the reduced diameter tubular part 18 having the four flat parts 18*a* as shown in FIG. 4 is obtained. Moreover, the electric resistance welded part 28 of the casing material 24 is disposed in one of the plurality of second protrusions 18*c*.

An operation of the first embodiment is now explained. The casing 11A includes the pair of holding tubular parts 16 and 17 in which the monolithic catalyst carriers 12 and 13 are respectively accommodated, and the reduced diameter tubular part 18 integrally connecting the holding tubular parts 16 and 17 to each other. The reduced diameter tubular part 18 is obtained by press-forming the portion, between the holding tubular parts 16 and 17, of the casing material 24 of a tubular shape that corresponds to that of the holding tubular parts 16 and 17. The flat parts 18*a* are respectively formed in the plurality of, for example, four places at intervals in the peripheral direction of the reduced diameter tubular part 18. The $O_2$ sensor 23 is attached to at least one (one in this embodiment) of these flat parts 18*a*. Accordingly, in order to form the flat parts 18*a*, press loads act on the casing material 24 from a plurality of (four in this embodiment) directions so as to prevent the press loads from becoming large and unequal in the peripheral direction of the reduced diameter tubular part 18, thereby enabling an amount of deformation per one place of the reduced diameter tubular part 18 to be minimized.

In addition, since the flat parts 18*a* are formed respectively in the plurality of (four in this embodiment) places at equal intervals in the peripheral direction of the reduced diameter tubular part 18, the flat parts 18*a* are disposed with a proper balance in the reduced diameter tubular part 18. Moreover, since adjacent ones of the flat parts 18*a* extend along planes orthogonal to each other, one and the other of the adjacent flat parts 18*a* reinforce each other such that one flat part 18*a* suppresses deformation of the other flat part 18*a*, thereby enabling strength of the reduced diameter tubular part 18 to be enhanced, and it is possible to reduce a thickness of the casing material 24 so as to reduce a weight of the casing 11A.

Moreover, since the first protrusions 18*b* protruding outward of the reduced diameter tubular part 18 and extending in the axial direction thereof are respectively formed on the opposite end portions, along the peripheral direction of the reduced diameter tubular part 18, of each of the flat parts 18*a*, radially inward contraction of portions of the reduced diameter tubular part 18 due to formation of the flat parts 18*a* can be absorbed by the first protrusions 18*b* and it is also possible to contribute to enhancement of strength of the flat parts 18*a*.

Also, since the second protrusions 18*c* are each formed on the outer surface of the reduced diameter tubular part 18 at the central portion in the peripheral direction between each adjacent ones of the plurality of flat parts 18*a*, it is possible to minimize a difference in peripheral length between the reduced diameter tubular part 18 and the holding tubular parts 16 and 17, prevent wrinkles and the like from occurring on the reduced diameter tubular part 18, and further enhance the strength of the reduced diameter tubular part 18.

Further, since the casing material 24 is an electric resistance welded tube with its electric resistance welded part 28 being disposed in one of the plurality of second protrusions 18*c*, an amount of deformation of the electric resistance welded part 28 can be minimized so as to reduce a burden applied to the electric resistance welded part 28.

Furthermore, since the reduced diameter tubular part 18 is obtained by press-forming the portion, between the holding tubular parts 16 and 17, of the tubular casing material 24 by using the plurality of split molds 29 and 30 that are divided in the peripheral direction of the casing material 24 and the split molds 29 each have the flat surface 29*a* for forming the flat part 18*a*, a press load by one split mold 29 or 30 can be reduced so as to minimize an amount of deformation of the reduced diameter tubular part 18, and thus it is possible to form the casing 11A while suppressing the deformation of the reduced diameter tubular part 18.

Figure 5:
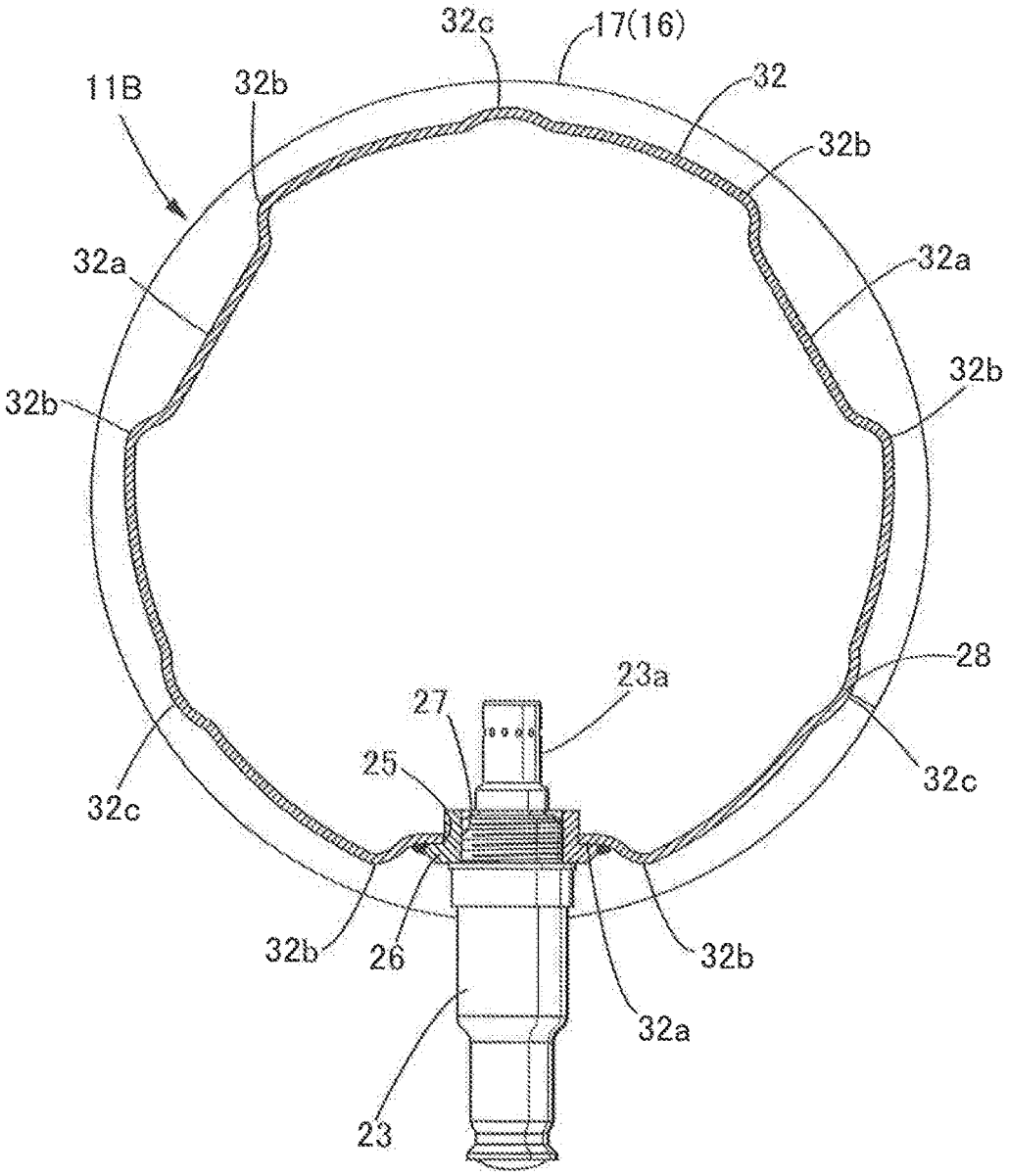
FIG. 5 is a cross sectional view of a catalytic converter according to a second embodiment.

A second embodiment of the present invention is now explained referring to FIG. 5. Parts corresponding to those of the first embodiment are denoted by the same reference numerals and symbols and only illustrated in the drawing, and detailed explanation thereof is omitted.

A reduced diameter tubular part 32 of a casing 11B is obtained by press-forming a portion, between holding tubular parts 16 and 17, of a casing material 24 of a tubular shape that corresponds to that of the holding tubular parts 16 and 17. Flat parts 32*a* are formed respectively in a plurality of, three in this second embodiment, places at equal intervals in the peripheral direction of the reduced diameter tubular part 32. An $O_2$ sensor 23 is attached to one of these flat parts 32*a*.

First protrusions or ribs 32*b* are respectively formed on opposite end portions, along a peripheral direction of the reduced diameter tubular part 32, of each of the flat parts 32*a*, the first protrusions 32*b* protruding outward of the reduced diameter tubular part 32 and extending in an axial direction thereof. Moreover, second protrusions or ribs 32*c* are each formed on an outer surface of the reduced diameter tubular part 32 at a central portion in the peripheral direction between each adjacent ones of the plurality of (three in this second embodiment) flat parts 32*a*, the second protrusions 32*c* protruding outward of the reduced diameter tubular part 32 and extending in the axial direction thereof.

Also in this second embodiment, an effect similar to that of the first embodiment can be achieved.

Figure 6:
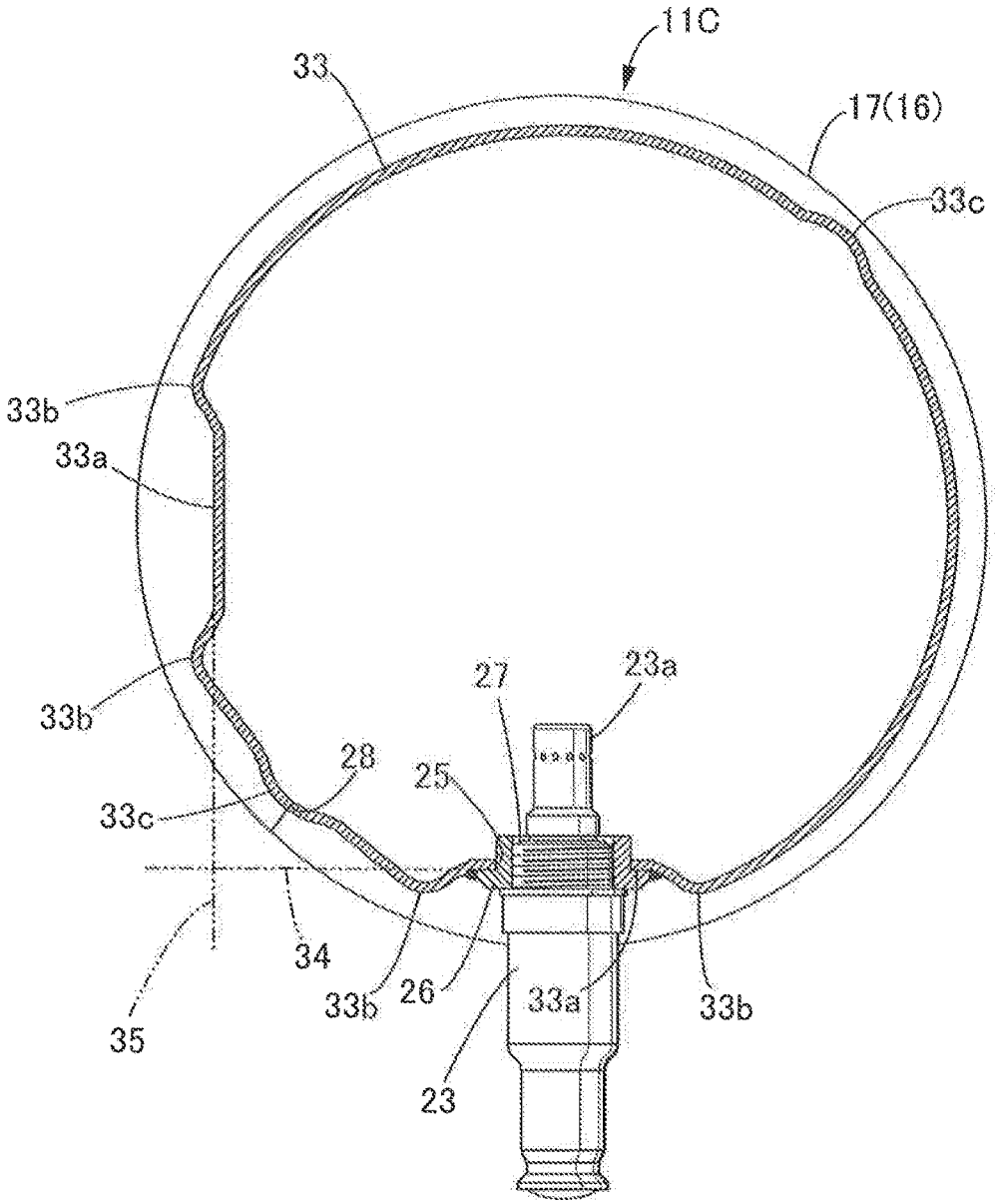
FIG. 6 is a cross sectional view of a catalytic converter according to a third embodiment.

A third embodiment of the present invention is now explained referring to FIG. 6. Parts corresponding to those of the first and second embodiments are denoted by the same reference numerals and symbols and only illustrated in the drawing, and detailed explanation thereof is omitted.

A reduced diameter tubular part 33 of a casing 11C is obtained by press-forming a portion, between holding tubular parts 16 and 17, of a casing material 24 of a tubular shape that corresponds to that of the holding tubular parts 16 and 17. Flat parts 33*a* are formed respectively in a plurality of, two in this third embodiment, places at intervals in a peripheral direction of the reduced diameter tubular part 33.

These flat parts 33*a* are formed in the reduced diameter tubular part 33 so as to extend along a pair of imaginary planes 34 and 35 orthogonal to each other. An $O_2$ sensor 23 is attached to one of these flat parts 33*a*.

First protrusions or ribs 33*b* protruding outward of the reduced diameter tubular part 33 and extending in an axial direction thereof are respectively formed on opposite end portions, along the peripheral direction of the reduced diameter tubular part 33, of each of the flat parts 33*a*. Second protrusions or ribs 33*c* protruding outward of the reduced diameter tubular part 33 and extending in the axial direction thereof are each formed on an outer surface of the reduced diameter tubular part 33 at a central portion in the peripheral direction between each adjacent ones of the plurality of (two in this third embodiment) flat parts 33*a*.

According to this third embodiment, since the pair of flat parts 33*a* of the reduced diameter tubular part 33 extend along the pair of imaginary planes 34 and 35 orthogonal to each other, the flat parts 33*a* influence each other so that one of the flat parts 33*a* suppresses the other flat part 33*a* from deforming, thereby enabling an amount of deformation per one place of the reduced diameter tubular part 33 to be minimized.

Figure 7:
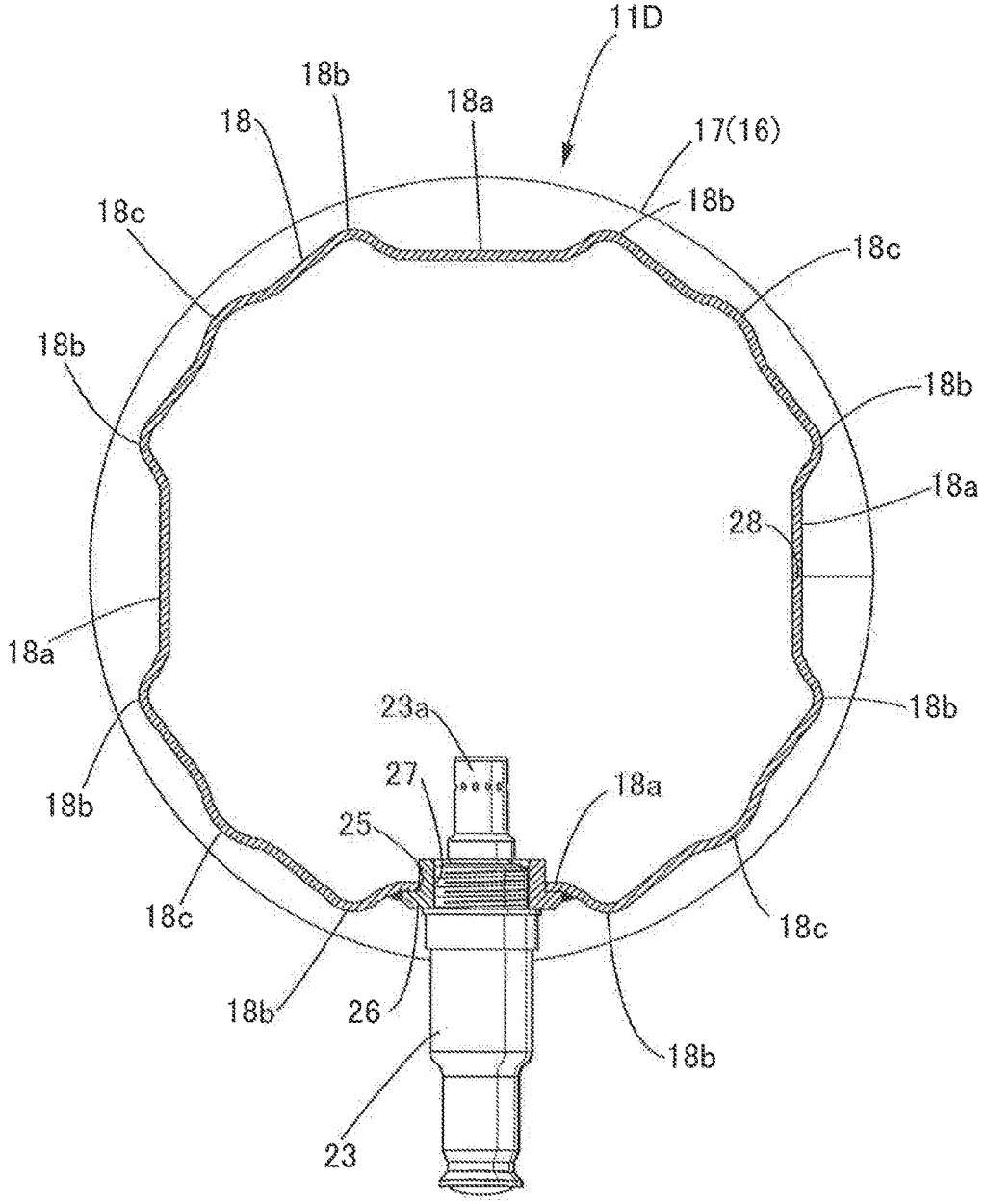
FIG. 7 is a sectional view according to a fourth embodiment, corresponding to FIG. 2.

A fourth embodiment of the present invention is now explained referring to FIG. 7. Parts corresponding to those of the first to third embodiments are denoted by the same reference numerals and symbols and only illustrated in the drawing, and detailed explanation thereof is omitted.

As in the first embodiment shown in FIGS. 1 to 4, a casing 11D of a catalytic converter of this fourth embodiment integrally includes a pair of holding tubular parts 16 and 17 and a reduced diameter tubular part 18 integrally connecting the holding tubular parts 16 and 17 to each other, the reduced diameter tubular part 18 being obtained by press-forming a portion, between the holding tubular parts 16 and 17, of a casing material 24 (see FIG. 1) that is an electric resistance welded tube including an electric resistance welded part 28.

Moreover, the casing material 24 is press-formed so as to have the electric resistance welded part 28 disposed in, out of four flat parts 18*a* of the reduced diameter tubular part 18, one of three flat parts 18*a* other than a flat part 18*a* to which an $O_2$ sensor 23 is attached.

According to this fourth embodiment, in a cross sectional shape of the casing 11D, that portion of the casing 11D in which the electric resistance welded part 28 is disposed does not change in shape, and compared with an uneven shape, stress applied to the electric resistance welded part 28 can be reduced.

Figure 8:
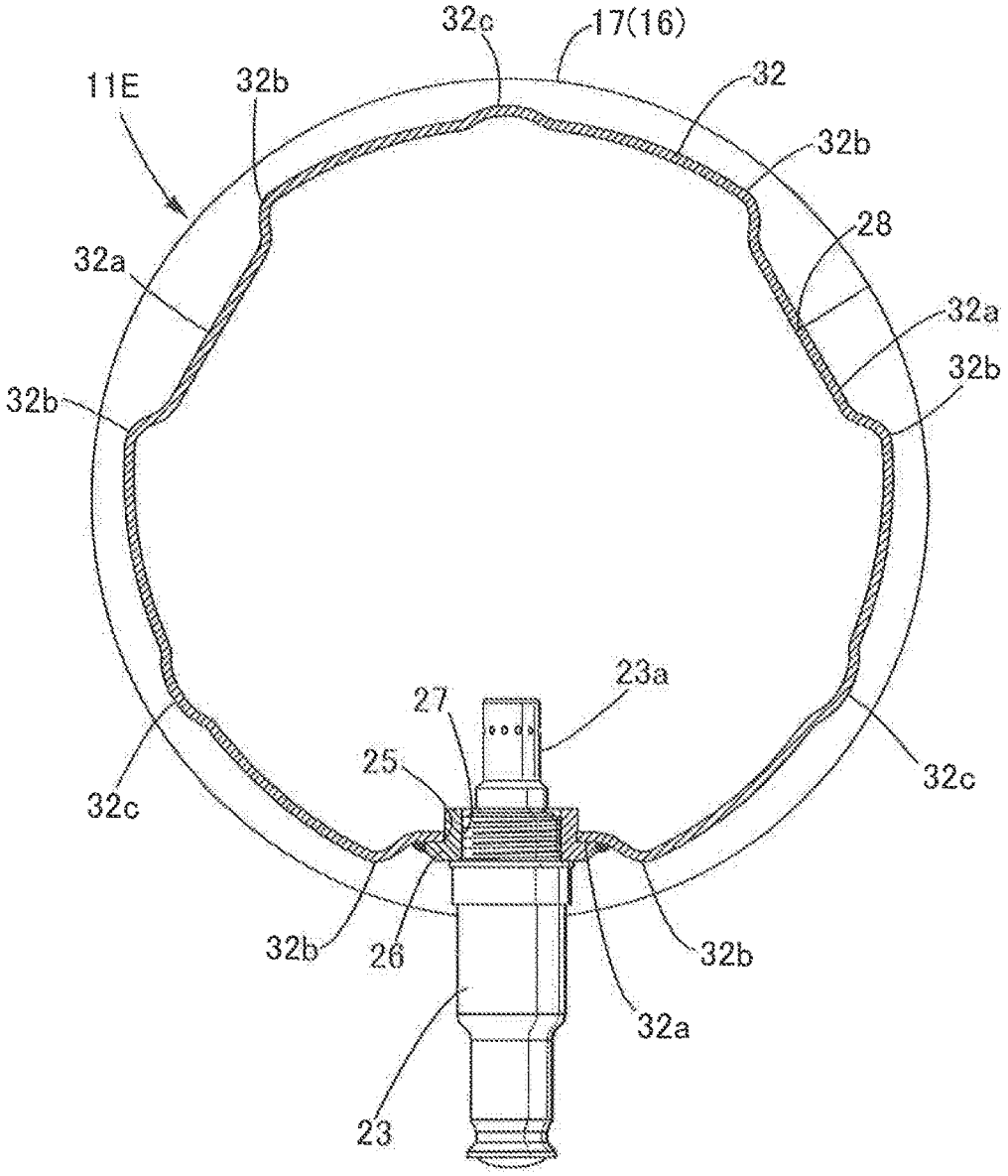
FIG. 8 is a sectional view according to a fifth embodiment, corresponding to FIG. 5.

A fifth embodiment of the present invention is now explained referring to FIG. 8. Parts corresponding to those of the first to fourth embodiments are denoted by the same reference numerals and symbols and only illustrated in the drawing, and detailed explanation thereof is omitted.

As in the second embodiment shown in FIG. 5, a casing 11E of a catalytic converter of this fifth embodiment integrally includes a pair of holding tubular parts 16 and 17 and a reduced diameter tubular part 32 integrally connecting the holding tubular parts 16 and 17 to each other, the reduced diameter tubular part 32 being obtained by press-forming a portion, between the holding tubular parts 16 and 17, of a casing material 24 (see FIG. 1) that is an electric resistance welded tube including an electric resistance welded part 28.

Moreover, the casing material 24 is press-formed so that the electric resistance welded part 28 is disposed in, out of three flat parts 32*a* of the reduced diameter tubular part 32, one of two flat parts 32*a* other than a flat part 32*a* to which an $O_2$ sensor 23 is attached.

Also in this fifth embodiment, as in the fourth embodiment, stress applied to the electric resistance welded part 28 can be reduced.

Figure 9:
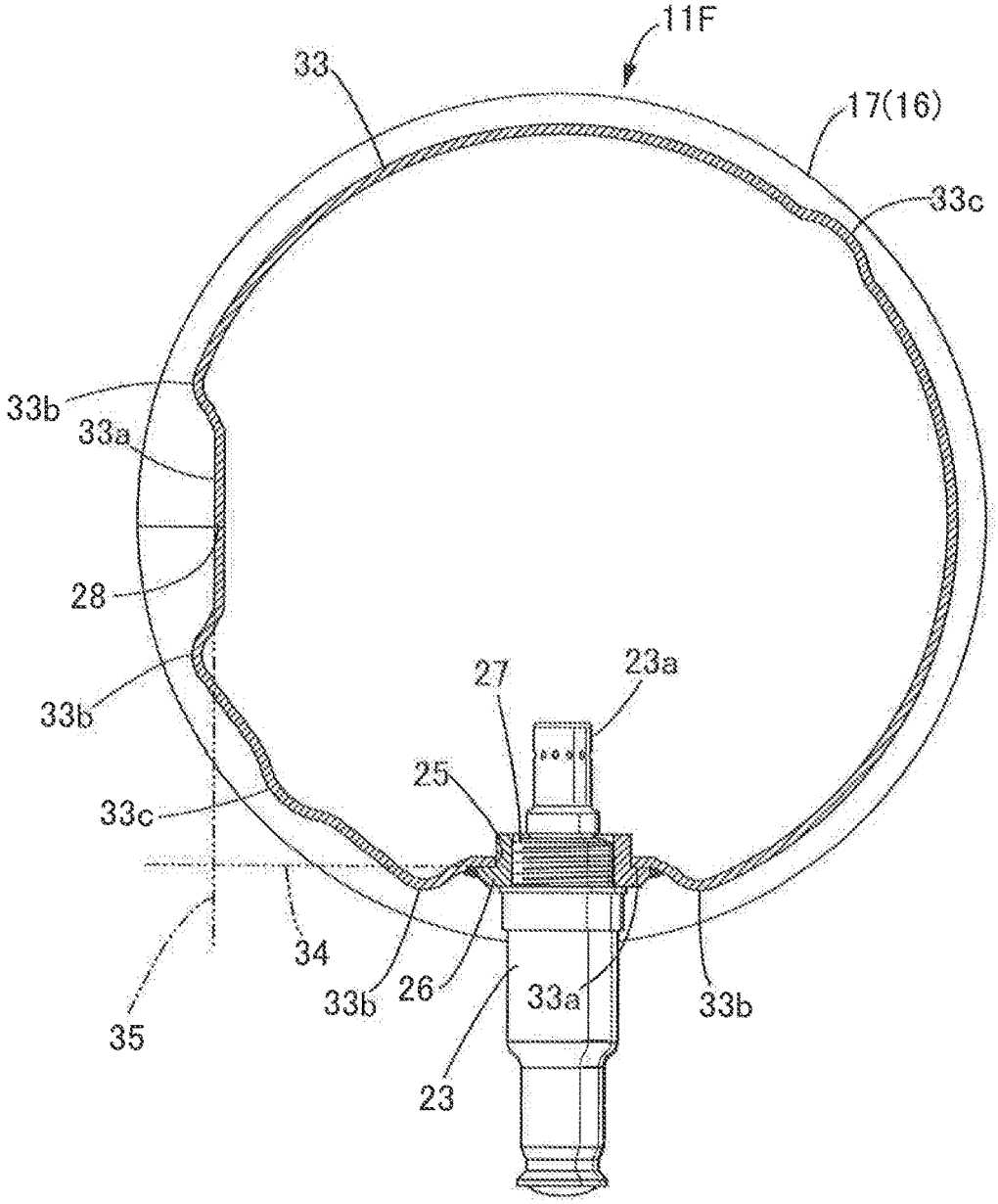
FIG. 9 is a sectional view according to a sixth embodiment, corresponding to FIG. 6.

A sixth embodiment of the present invention is now explained referring to FIG. 9. Parts corresponding to those of the first to fifth embodiments are denoted by the same reference numerals and symbols and only illustrated in the drawing, and detailed explanation thereof is omitted.

As in the third embodiment shown in FIG. 6, a casing 11F of a catalytic converter of this sixth embodiment integrally includes a pair of holding tubular parts 16 and 17 and a reduced diameter tubular part 33 integrally connecting the holding tubular parts 16 and 17 to each other, the reduced diameter tubular part 33 being obtained by press-forming a portion, between the holding tubular parts 16 and 17, of a casing material 24 (see FIG. 1) that is an electric resistance welded tube including an electric resistance welded part 28.

Moreover, the casing material 24 is press-formed so that the electric resistance welded part 28 is disposed in one of a pair of flat parts 33*a* of the reduced diameter tubular part 33 other than a flat part 33*a* to which an $O_2$ sensor 23 is attached.

Also in this sixth embodiment, as in the fourth and fifth embodiments, stress applied to the electric resistance welded part 28 can be reduced.

Embodiments of the present invention are explained above, but the present invention is not limited to the above-mentioned embodiments and may be modified in a variety of ways as long as the modifications do not depart from the gist of the present invention.

What is claimed is:

1. A catalytic converter comprising:

a tubular casing including at least a pair of holding tubular parts and a reduced diameter tubular part that integrally connects the holding tubular parts to each other; and a monolithic catalyst carrier accommodated in each of the holding tubular parts, the reduced diameter tubular part being obtained by press-forming a portion, between the holding tubular parts, of a casing material of a tubular shape that corresponds to that of the holding tubular parts, wherein flat parts are formed respectively in a plurality of places at intervals in a peripheral direction of the reduced diameter tubular part, a sensor being attached to at least one of the flat parts, and wherein a pair of the flat parts are formed in the reduced diameter tubular part so as to extend along a pair of imaginary planes orthogonal to each other.

2. A catalytic converter comprising:

a tubular casing including at least a pair of holding tubular parts and a reduced diameter tubular part that integrally connects the holding tubular parts to each other; and a monolithic catalyst carrier accommodated in each of the holding tubular parts, the reduced diameter tubular part being obtained by press-forming a portion, between the holding tubular parts, of a casing material of a tubular shape that corresponds to that of the holding tubular parts, wherein flat parts are formed respectively in a plurality of places at intervals in a peripheral direction of the reduced diameter tubular part, a sensor being attached to at least one of the flat parts, and wherein the flat parts are formed respectively in a plurality of places at equal intervals in the peripheral direction of the reduced diameter tubular part.

3. A catalytic converter comprising:

a tubular casing including at least a pair of holding tubular parts and a reduced diameter tubular part that integrally connects the holding tubular parts to each other; and a monolithic catalyst carrier accommodated in each of the holding tubular parts, the reduced diameter tubular part being obtained by press-forming a portion, between the holding tubular parts, of a casing material of a tubular shape that corresponds to that of the holding tubular parts, wherein flat parts are formed respectively in a plurality of places at intervals in a peripheral direction of the reduced diameter tubular part, a sensor being attached to at least one of the flat parts, and wherein first protrusions are respectively formed on opposite end portions, along the peripheral direction of the reduced diameter tubular part, of each of the flat parts, the first protrusions protruding outward on the reduced diameter tubular part and extending in an axial direction of the reduced diameter tubular part.

4. The catalytic converter according to claim 1, wherein first protrusions are respectively formed on opposite end portions, along the peripheral direction of the reduced diameter tubular part, of each of the flat parts, the first protrusions protruding outward on the reduced diameter tubular part and extending in an axial direction of the reduced diameter tubular part.

5. The catalytic converter according to claim 2, wherein first protrusions are respectively formed on opposite end portions, along the peripheral direction of the reduced diameter tubular part, of each of the flat parts, the first protrusions protruding outward on the reduced diameter tubular part and extending in an axial direction of the reduced diameter tubular part.

6. The catalytic converter according to claim 3, wherein second protrusions are formed on an outer surface of the reduced diameter tubular part at a central portion in the peripheral direction between adjacent ones of the plurality of flat parts, the second protrusions protruding outward on the reduced diameter tubular part and extending in the axial direction of the reduced diameter tubular part.

7. The catalytic converter according to claim 1, wherein the tubular casing is an electric resistance welded tube which has an electric resistance welded part disposed in one of the plurality of flat parts.

8. The catalytic converter according to claim 2, wherein the tubular casing is an electric resistance welded tube which has an electric resistance welded part disposed in one of the plurality of flat parts.

9. The catalytic converter according to claim 6, wherein the tubular casing is an electric resistance welded tube which has an electric resistance welded part disposed in one of the plurality of second protrusions.

10. The catalytic converter according to claim 1, wherein the tubular casing is a product of a process comprising press-forming said portion, between the holding tubular parts, of a tubular casing material using a plurality of split molds that are divided in a peripheral direction of the tubular casing material and include split molds each having a flat surface for forming the flat part.

11. The catalytic converter according to claim 3, wherein the tubular casing is a product of a process comprising press-forming said portion, between the holding tubular parts, of a tubular casing material using a plurality of split molds that are divided in a peripheral direction of the tubular casing material and include split molds each having a flat surface for forming the flat part.

12. The catalytic converter according to claim 2, wherein the tubular casing is a product of a process comprising press-forming said portion, between the holding tubular parts, of a tubular casing material using a plurality of split molds that are divided in a peripheral direction of the tubular casing material and include split molds each having a flat surface for forming the flat part.

* * * * *